US008170451B2

(12) United States Patent
Murauchi et al.

(10) Patent No.: US 8,170,451 B2
(45) Date of Patent: May 1, 2012

(54) DEVELOPING APPARATUS INCLUDING GUIDE FOR PREVENTING PACKING AND LEAKING OF DEVELOPER AND IMAGE FORMING APPARATUS PROVIDED WITH THE SAME

(75) Inventors: Junji Murauchi, Toyokawa (JP); Chikara Tsutsui, Nishinomiya (JP); Tetsuya Kagawa, Toyokawa (JP); Hiroaki Takada, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 58 days.

(21) Appl. No.: 12/820,196

(22) Filed: Jun. 22, 2010

(65) Prior Publication Data

US 2010/0322673 A1 Dec. 23, 2010

(30) Foreign Application Priority Data

Jun. 22, 2009 (JP) ..... 2009-147678

(51) Int. Cl.
*G03G 15/08* (2006.01)

(52) U.S. Cl. ..... 399/254

(58) Field of Classification Search ..... 399/254, 399/258, 272

See application file for complete search history.

(56) References Cited

FOREIGN PATENT DOCUMENTS

| | | | |
|---|---|---|---|
| JP | 9-152774 | A | 6/1997 |
| JP | 2004-326033 | A | 11/2004 |
| JP | 2005-233992 | | 9/2005 |
| JP | 2005-345858 | | 12/2005 |

OTHER PUBLICATIONS

Murauchi et al., U.S. Appl. No. 12/820,189, filed Jun. 22, 2010, entitled "Developing Apparatus and Image Forming Apparatus Provided With the Same".

Saito et al., U.S. Appl. No. 12/820,396, filed Jun. 22, 2010, entitled "Developing Apparatus and Image Forming Apparatus Provided With the Same".

Tsutsui et al., U.S. Appl. No. 12/820,172, filed Jun. 22, 2010, entitled "Developing Apparatus and Image Forming Apparatus Provided With the Same".

Tsutsui et al., U.S. Appl. No. 12/820,444, filed Jun. 22, 2010, entitled "Developing Apparatus and Image Forming Apparatus Provided With the Same".

Saito et al., U.S. Appl. No. 12/820,450, filed Jun. 22, 2010, entitled "Developing Apparatus and Image Forming Apparatus Provided With the Same".

Murauchi et al., U.S. Appl. No. 12/820,496, filed Jun. 22, 2010, entitled "Developing Apparatus and Image Forming Apparatus Provided With the Same". Office Action (Notification of Reason for Refusal) dated Apr. 19, 2011, issued in the corresponding Japanese Patent Application No. 2009-147670, and an English Translation thereof.

*Primary Examiner* — William J Royer

(74) *Attorney, Agent, or Firm* — Buchanan Ingersoll & Rooney PC

(57) ABSTRACT

A housing of a developing apparatus is provided with a conveying member in a developer supplying and recovering portion, and with first and second agitating members rotating from the below to the above in portions opposed to each other in a developer agitating portion. A guide is provided in an inner bottom surface of the housing between the first and second agitating members. A discharge portion provided with a developer discharge port is provided on a downstream side of the developer agitating portion in a developer conveying direction of the first agitating member. A suitable amount of developer can be circulated while conveying a part of an excess amount of developer in a circulating conveying path to the discharge portion and discharging from the developer discharge port. Packing and leaking of the developer within the developing apparatus and breakage of the developing apparatus can be prevented and also a good image can be obtained even if high printing images are continuously provided.

8 Claims, 15 Drawing Sheets

*Fig. 7*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | |
| | | | | | | | | | | | | | | guide height h | conversion | | | | | concentration unevenness |
| 1 | 1 | 400 rpm | $\phi$30 | 300 rpm | $\phi$30 | no rib | 300 rpm | $\phi$30 | no rib | none | 2 | 1.5 | 16.5 | 0 | 0.0R | from below to above | between two shafts | rear of first agitating | | × |
| 2 | 2 | 400 rpm | $\phi$30 | 300 rpm | $\phi$30 | no rib | 300 rpm | $\phi$30 | no rib | none | 2 | 1.5 | 16.5 | 0 | 0.0R | from below to above | between two shafts | rear of second agitating | developer leakage | × |
| 3 | 3 | 400 rpm | $\phi$30 | 300 rpm | $\phi$30 | no rib | 300 rpm | $\phi$30 | no rib | none | 2 | 1.5 | 16.5 | 1.65 | 0.1R | from below to above | between two shafts | rear of first agitating | | × |
| 4 | 4 | 400 rpm | $\phi$30 | 300 rpm | $\phi$30 | no rib | 300 rpm | $\phi$30 | no rib | none | 2 | 1.5 | 16.5 | 3.3 | 0.2R | from below to above | between two shafts | rear of first agitating | | ○ |
| 5 | 5 | 400 rpm | $\phi$30 | 300 rpm | $\phi$30 | no rib | 300 rpm | $\phi$30 | no rib | none | 2 | 1.5 | 16.5 | 8.25 | 0.5R | from below to above | between two shafts | rear of first agitating | | ○ |
| 6 | 6 | 400 rpm | $\phi$30 | 300 rpm | $\phi$30 | no rib | 300 rpm | $\phi$30 | no rib | none | 2 | 1.5 | 16.5 | 19.8 | 1.2R | from below to above | between two shafts | rear of first agitating | | ○ |
| 7 | 7 | 400 rpm | $\phi$30 | 300 rpm | $\phi$30 | no rib | 300 rpm | $\phi$30 | no rib | none | 2 | 1.5 | 16.5 | 21.45 | 1.3R | from below to above | between two shafts | rear of first agitating | | × |

*Fig.8*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 16 | 16 | 400 rpm | $\phi$ 20 | 300 rpm | $\phi$ 20 | no rib | 300 rpm | $\phi$ 20 | no rib | none | 2 | 1.5 | 11.5 | 1.15 | 0.1R | from below to above | between two shafts | rear of first agitating | | × |
| 17 | 17 | 400 rpm | $\phi$ 20 | 300 rpm | $\phi$ 20 | no rib | 300 rpm | $\phi$ 20 | no rib | none | 2 | 1.5 | 11.5 | 2.3 | 0.2R | from below to above | between two shafts | rear of first agitating | | ○ |
| 18 | 18 | 400 rpm | $\phi$ 20 | 300 rpm | $\phi$ 20 | no rib | 300 rpm | $\phi$ 20 | no rib | none | 2 | 1.5 | 11.5 | 3.45 | 0.3R | from below to above | between two shafts | rear of first agitating | | ○ |
| 19 | 19 | 400 rpm | $\phi$ 20 | 300 rpm | $\phi$ 20 | no rib | 300 rpm | $\phi$ 20 | no rib | none | 2 | 1.5 | 11.5 | 12.65 | 1.1R | from below to above | between two shafts | rear of first agitating | | ○ |
| 20 | 20 | 400 rpm | $\phi$ 20 | 300 rpm | $\phi$ 20 | no rib | 300 rpm | $\phi$ 20 | no rib | none | 2 | 1.5 | 11.5 | 13.8 | 1.2R | from below to above | between two shafts | rear of first agitating | | ○ |
| 21 | 21 | 400 rpm | $\phi$ 20 | 300 rpm | $\phi$ 20 | no rib | 300 rpm | $\phi$ 20 | no rib | none | 2 | 1.5 | 11.5 | 14.95 | 1.3R | from below to above | between two shafts | rear of first agitating | | × |

*Fig.9*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 22 | 22 | 400 rpm | $\phi$30 | 300 rpm | $\phi$30 | no rib | 300 rpm | $\phi$30 | no rib | none | 2 | 1.5 | 16.5 | 3.3 | 0.2R | from below to above | between two shafts | rear of first agitating | | ○ |
| 23 | 23 | 400 rpm | $\phi$30 | 300 rpm | $\phi$30 | no rib | 300 rpm | $\phi$30 | no rib | none | 2 | 3 | 18 | 3.6 | 0.2R | from below to above | between two shafts | rear of first agitating | | ○ |
| 24 | 24 | 400 rpm | $\phi$30 | 300 rpm | $\phi$30 | no rib | 300 rpm | $\phi$30 | no rib | none | 2 | 5 | 20 | 4 | 0.2R | from below to above | between two shafts | rear of first agitating | | × |

*Fig.10*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 25 | 25 | 400 rpm | $\phi$30 | 300 rpm | $\phi$30 | no rib | 300 rpm | $\phi$30 | no rib | none | 2 | 1.5 | 16.5 | 3.3 | 0.2R | from below to above | between two shafts | rear of first agitating | | ○ |
| 27 | 27 | 600 rpm | $\phi$30 | 450 rpm | $\phi$30 | no rib | 450 rpm | $\phi$30 | no rib | none | 2 | 1.5 | 16.5 | 3.3 | 0.2R | from below to above | between two shafts | rear of first agitating | | ○ |
| 29 | 29 | 800 rpm | $\phi$30 | 600 rpm | $\phi$30 | no rib | 600 rpm | $\phi$30 | no rib | none | 2 | 1.5 | 16.5 | 3.3 | 0.2R | from below to above | between two shafts | rear of first agitating | | ○ |

*Fig. 11*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 5 | 5 | 400 rpm | $\phi$30 | 300 rpm | $\phi$30 | no rib | 300 rpm | $\phi$30 | no rib | none | 2 | 1.5 | 16.5 | 8.25 | 0.5R | from below to above | between two shafts | rear of first agitating | reference | ○ |
| 8 | 8 | 400 rpm | $\phi$30 | 300 rpm | $\phi$30 | no rib | 300 rpm | $\phi$30 | no rib | to communi-cation portation | 2 | 1.5 | 16.5 | 8.25 | 0.5R | from below to above | between two shafts | rear of first agitating | 10% down | ○ |
| 9 | 9 | 400 rpm | $\phi$30 | 300 rpm | $\phi$30 | no rib | 300 rpm | $\phi$30 | no rib | over communi-cation portation | 2 | 1.5 | 16.5 | 8.25 | 0.5R | from below to above | between two shafts | rear of first agitating | 20% down | ○ |

*Fig.12*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 3 | 3 | 400 rpm | $\phi$30 | 300 rpm | $\phi$30 | no rib | 300 rpm | $\phi$30 | no rib | none | 2 | 1.5 | 16.5 | 1.65 | 0.1R | from below to above | between two shafts | rear of first agitating | | × |
| 10 | 10 | 400 rpm | $\phi$30 | 300 rpm | $\phi$30 | rib 0 deg. | 300 rpm | $\phi$30 | no rib | none | 2 | 1.5 | 16.5 | 1.65 | 0.1R | from below to above | between two shafts | rear of first agitating | | △ |
| 11 | 11 | 400 rpm | $\phi$30 | 300 rpm | $\phi$30 | no rib | 300 rpm | $\phi$30 | rib 0 deg. | none | 2 | 1.5 | 16.5 | 1.65 | 0.1R | from below to above | between two shafts | rear of first agitating | | △ |
| 12 | 12 | 400 rpm | $\phi$30 | 300 rpm | $\phi$30 | rib 0 deg. | 300 rpm | $\phi$30 | rib 0 deg. | none | 2 | 1.5 | 16.5 | 1.65 | 0.1R | from below to above | between two shafts | rear of first agitating | | △ |

*Fig. 14*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | |
| | | | | | | | | | | | | | | guide height h | conversion | | | | | concentration unevenness |
| 12 | 12 | 400 rpm | $\phi$30 | 300 rpm | $\phi$30 | rib 0 deg. | 300 rpm | $\phi$30 | rib 0 deg. | none | 2 | 1.5 | 16.5 | 1.65 | 0.1R | from below to above | between two shafts | rear of first agitating | | △ |
| 14 | 14 | 400 rpm | $\phi$30 | 300 rpm | $\phi$30 | rib 0 deg. | 300 rpm | $\phi$30 | rib 180 deg. | none | 2 | 1.5 | 16.5 | 1.65 | 0.1R | from below to above | between two shafts | rear of first agitating | | × |
| 15 | 15 | 400 rpm | $\phi$30 | 300 rpm | $\phi$30 | rib 0 deg. | 360 rpm | $\phi$30 | rib 180 deg. | none | 2 | 1.5 | 16.5 | 1.65 | 0.1R | from below to above | between two shafts | rear of first agitating | | △ |

*Fig.17*

| image forming apparatus | developing apparatus | conveying member | | first agitating member | | | second agitating member | | | | housing | | | | | rotating direction | replenishing position | discharge position | evaluation | |
|---|---|---|---|---|---|---|---|---|---|---|---|---|---|---|---|---|---|---|---|---|
| | | rotating speed | outer diameter | rotating speed | outer diameter | rib | rotating speed | outer diameter | rib | backward wound | distance between impeller blades | distance between bottom surface and impeller blade | R | guide height | | | | | | concentration unevenness |
| | | | | | | | | | | | | | | guide height h | conversion | | | | | |
| 3 | 3 | 400 rpm | $\phi$30 | 300 rpm | $\phi$30 | no rib | 300 rpm | $\phi$30 | no rib | none | 2 | 1.5 | 16.5 | 1.65 | 0.1R | from below to above | between two shafts | rear of first agitating | | × |
| 13 | 13 | 400 rpm | $\phi$30 | 300 rpm | $\phi$30 | no rib | 300 rpm | $\phi$30 | no rib | none | 2 | 1.5 | 16.5 | 1.65 | 0.1R | from below to above | wall side | rear of first agitating | | △ |

DEVELOPING APPARATUS INCLUDING GUIDE FOR PREVENTING PACKING AND LEAKING OF DEVELOPER AND IMAGE FORMING APPARATUS PROVIDED WITH THE SAME

This application is based on application No. 2009-147678 filed in Japan on Jun. 22, 2009, the contents of which are hereby incorporated by reference.

BACKGROUND OF THE INVENTION

1. Field of the Invention

The present invention relates to a developing apparatus of an electrophotographic type image forming apparatus installed according to a monochrome/color and standalone/network connection type of copying machine, printer, facsimile, complex machine of them, and the like, and an image forming apparatus provided with the same.

2. Description of Related Art

Conventionally, in an electrophotographic developing apparatus, a mono-component development and a two-component development are employed. In the mono-component development, since a toner comes into contact with each of members of a developing device in a portion supplying the toner, a portion charging the toner, a portion discharging the toner, and a portion recovering the toner, a load is applied to the toner. A thermoplastic resin is used for the toner, and inorganic fine particles are attached and treated as a fluidity modifying agent to the surface thereof. Accordingly, the toner surface is thermally changed and the inorganic fine particles are embedded due to the load. Since a rotating speed of each of the members becomes high in a high speed machine, a greater load is applied to the toner. Therefore, a speeding up has a limit. Further, in recent years, a diameter of the toner is significantly reduced according to a high image quality and is frequently set to be equal to or less than 6 μm. Since a larger amount of after treatment agent is treated for the toner having the small diameter as mentioned above, and the fluidity is deteriorated, an aggregation of the toner and the embedding of the after treatment agent are significantly caused by the load mentioned above. Further, a tendency of a low temperature fixing is significant as an environmental countermeasure. Accordingly, a thermal resistance of the toner is lowered, causing a further disadvantageous condition with respect to the load mentioned above.

In the two-component development, a toner charged due to triboelectric charging between the toner and a carrier is attached to an electrostatic latent image formed on an image carrier so as to develop. Within a developing device, a charged state of the toner is maintained by keeping a rate of the toner and the carrier constant. However, if the electrostatic latent image formed on the image carrier is developed with the toner, the toner comes short. Accordingly, the toner is replenished by a replenishing section. The toner replenished by the replenishing section is not charged yet, and is charged while being agitated and conveyed with a developer within the developing device by an agitating and conveying section within the developing device. In this method, since the charging application is carried out by mixing the particles, the load applied to the toner is small. Accordingly, the toner has a longer service life in comparison with the mono-component development, and an excellent high speed response can be obtained.

On the other hand, in recent years, an electrophotographic type of product has been introduced in a field of a high production region, a system having a high speed and a long service life has been proposed. In the developing apparatus, there have been provided an apparatus having a plurality of developing rollers, an apparatus having a trickle mechanism gradually replacing a developer, a hybrid developing apparatus using a two-component developer for a supply roller portion and a mono-component toner for a developing roller portion, and a developing apparatus obtained by combining them. In any developing apparatus, the toner is replenished, and the toner is charged while being agitated and conveyed with the developer within the developing device by the agitating and conveying section within the developing device.

In the toner replenishing type developing apparatus, if a high printing rate of print is continuously carried out, the toner comes short and the uncharged toner is accordingly replenished. Then, if the replenished toner is conveyed in a state in which a charged amount is low, without being sufficiently agitated, and is supplied onto the developing roller, image deterioration such as toner scattering and toner fogging occurs.

Further, since a time for which the replenished toner is conveyed onto the developing roller becomes short due to the recent speeding up of the apparatus, the problem mentioned above becomes further serious. Then, there has been proposed a developing device using two agitating members for providing a developing device which efficiently and well agitates a developer as well as preventing the replenished toner from being conveyed onto the developing roller without being sufficiently agitated, and has no fogging and no scattering.

SUMMARY OF THE INVENTION

However, in developing apparatus having three axes of one supplying and conveying member and two agitating members such as developing apparatuses disclosed in Japanese Unexamined Patent Publication Nos. H09-152774 and 2004-326033, it is necessary to take into consideration a circulation balance with regard to which axis a discharge port discharging the developer should be provided. Further, if the developer can not be efficiently discharged, the amount of the developer inside the developing apparatus becomes too large, so that there arise such problems that the image forming apparatus is broken, the developer leaks from an end portion of the developing roller, and an image defect such as concentration unevenness in a longitudinal direction is caused.

Accordingly, an object of the present invention is to provide an image forming apparatus which can obtain a good image without generating any trouble such as a breakage of the image forming apparatus and a developer leakage even if an excess developer is supplied to a developing apparatus, and without generating deterioration of an image quality even if a high printing ratio of print is successively carried out.

The present invention provides a developing apparatus and an image forming apparatus provided with the same, including:

a housing provided with a developer supplying and recovering portion and a developer agitating portion that are communicated with each other and form a circulating conveying path for a two-component developer including a toner and a carrier, so as to be adjacent via a partition wall having communication portions in both end portions;

a developer carrier provided on an opposite side to the developer agitating portion in the developer supplying and recovering portion, and attaching the toner to a photoconductor so as to develop an electrostatic latent image on the photoconductor;

a conveying member arranged in the developer supplying and recovering portion in such a manner as to extend along a direction of a rotating axis of the developer carrier, supplying the developer to the developer carrier, conveying the developer in a longitudinal direction, and delivering the developer to the developer agitating portion through the communication portion;

a first agitating member arranged in the developer agitating portion so as to extend along a direction of a rotating axis of the conveying member adjacent to the partition wall, conveying the developer in an inverse direction to the conveying direction by the conveying member while agitating, and delivering the developer to the developer supplying and recovering portion through the communication portion;

a second agitating member arranged in the developer agitating portion so as to extend along a direction of a rotating axis of the first agitating member adjacent to the first agitating member, conveying the developer in the same direction as the conveying direction by the first agitating member while agitating, and delivering the developer to the developer supplying and recovering portion through the communication portion; and a projection-shaped guide arranged in an inner bottom surface of the housing positioned between the first agitating member and the second agitating member so as to extend from one side of the direction of the rotating axis of the first agitating member and the second agitating member to the other side, wherein a cross sectional shape of the guide which is orthogonal to the axial direction of the rotating axis being a mountain shape with a wide foot portion, wherein the guide is arranged in such a manner that gaps between respective outermost portions of the first agitating member and the second agitating member, and the inner bottom surface of the housing and the guide become 1.5 mm or more and 3 mm or less, wherein the first agitating member and the second agitating member are rotated in such a manner that the developer is conveyed from the below to the above in portions which are opposed to each other, and wherein a braking portion inhibiting the developer from being discharged is provided on a downstream side of the developer agitating portion of the housing in the developer conveying direction of the first agitating member, a discharge portion is provided on a downstream side of the braking portion, and the discharge portion is provided with a developer discharge port discharging the developer coming to the discharge portion over the braking portion.

BRIEF DESCRIPTION OF THE DRAWINGS

FIG. 7 is a data table showing viewed results of images printed by image forming apparatuses;

FIG. 8 is a data table showing viewed results of images printed by image forming apparatuses;

FIG. 9 is a data table showing viewed results of images printed by image forming apparatuses;

FIG. 10 is a data table showing viewed results of images printed by image forming apparatuses;

FIG. 11 is a data table showing viewed results of images printed by image forming apparatuses;

FIG. 12 is a data table showing viewed results of images printed by image forming apparatuses;

FIG. 14 is a data table showing viewed results of images printed by image forming apparatuses;

FIG. 17 is a data table showing viewed results of images printed by image forming apparatuses;

DETAILED DESCRIPTION OF THE PREFERRED EMBODIMENTS

A description will be given below of an embodiment according to the present invention with reference to the accompanying drawings.

(Construction)

Figure 1:
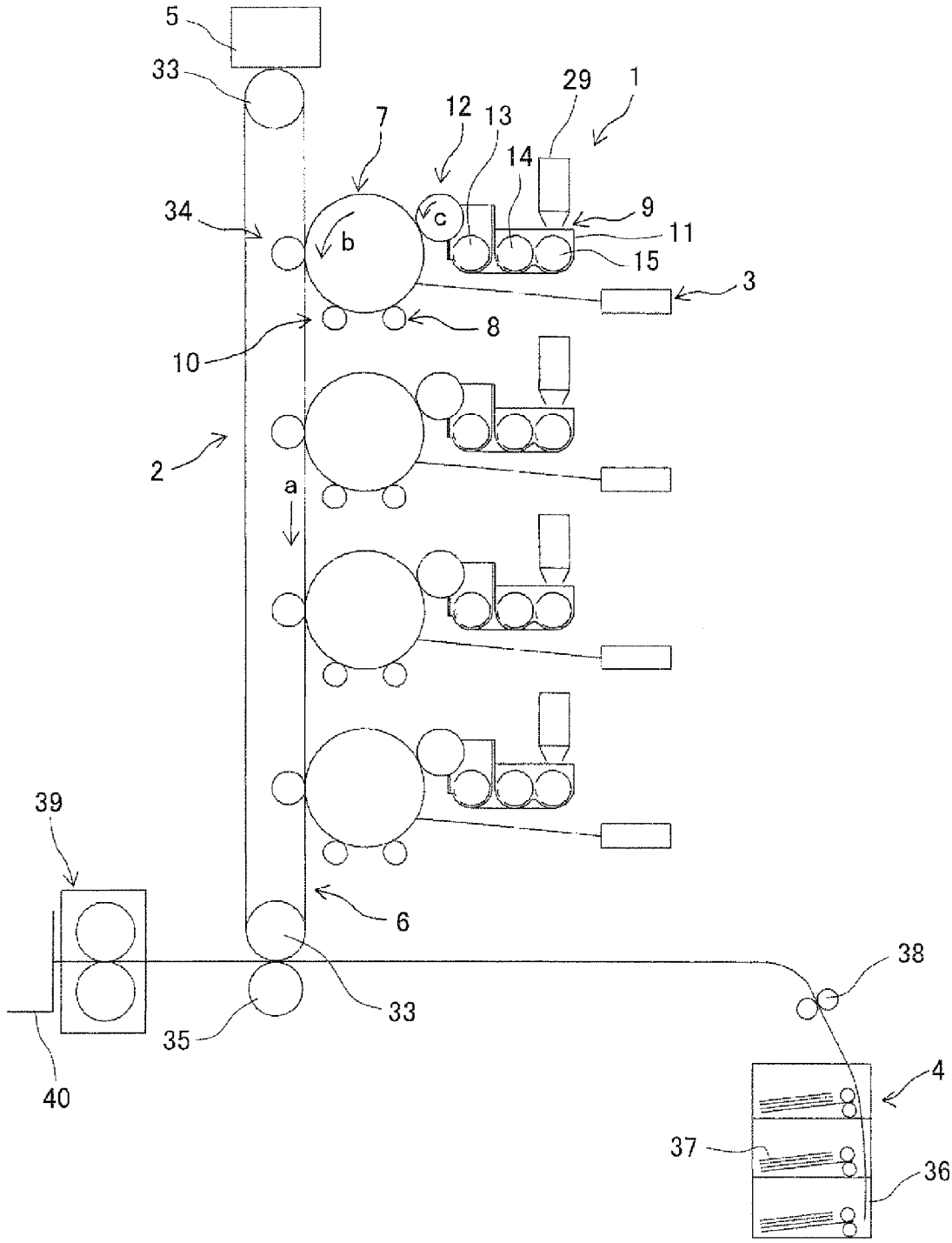
FIG. 1 is a schematic view of a structure of an image forming apparatus.

FIG. 1 shows a schematic view of an image forming apparatus. The image forming apparatus is roughly provided with an image forming unit 1, a transfer unit 2, an exposure unit 3, a paper feed unit 4, a cleaning unit 5, a control unit (not shown) and the like. However, the present invention is not applied only to this kind of image forming apparatus, but can be applied, for example, to a so-called four-cycle type color image forming apparatus, and a monochrome output image forming apparatus. Further, it can be applied to a copying machine, a printer, a facsimile, and a complex machine complexly provided with these functions.

The image forming units 1 are arranged at four positions along an intermediate transfer belt 6 of the transfer unit 2, and form a color image on a surface of the intermediate transfer belt 6 by forming images of yellow (Y), magenta (M), cyan (C) and black (Bk) from a side close to the cleaning unit 5. Each of the image forming units 1 is provided with a charging apparatus 8, a developing apparatus 9, a cleaning apparatus 10 and the like around a photoconductor drum 7.

The charging apparatus 8 forms a predetermined surface potential on a surface of the photoconductor drum 7. The surface potential comes to an electrostatic latent image by being exposed by the exposure unit 3.

The developing apparatus 9 is structured such as to accommodate a developing roller (a developer carrier) 12, a conveying screw (a conveying member) 13, a first agitating screw (a first agitating member) 14 and a second agitating screw (a second agitating member) 15 within a housing 11. The developing apparatus 9 will be mentioned in detail later.

A hopper 29 replenishing a replenishing two-component developer (hereinafter, referred simply to as the developer) including a toner and a carrier is detachably provided above the developing apparatus 9.

The cleaning apparatus 10 recovers and cleans the toner which is left on the surface after being transferred to the surface of the photoconductor drum 7.

The transfer unit 2 is structured such as to bridge the intermediate transfer belt 6 over a pair of support rollers 33, drive one of the pair of support rollers 33 by a driving section (not shown), and move in a circulating manner the intermediate transfer belt 6 in a direction shown by an arrow "a" from the developing apparatus 9 for yellow (Y) toward the developing apparatus 9 for black (Bk), and is provided with a primary transfer portion 34 and a secondary transfer portion 35.

The exposure unit 3 irradiates the photoconductor drum 7 with laser light, and forms an electrostatic latent image corresponding to image data read by a scanner (not shown).

The paper feed unit 4 feeds a recording medium 37 accommodated in a cassette 36 to the secondary transfer portion 35 via a conveying roller 38 sequentially. The toner image is transferred onto the recording medium 37 fed to the secondary transfer portion 35, and is fed out to a discharge tray 40 after the transferred toner image is fixed by a fixing unit 39.

The cleaning unit 5 can come close to and away from the intermediate transfer belt 6, and recovers and cleans the toner remaining on the intermediate transfer belt 6 by coming close thereto.

The control unit (not shown) executes a replenishing process of the developer based on a detection voltage inputted from a toner concentration sensor 31 (FIG. 5) of the developing apparatus 9.

In the present embodiment, the developer includes the toner and the carrier for charging the toner. The toner is not particularly limited, but can use a known toner which is generally used. The developer may be structured such as to further include an external additive agent. A toner particle diameter about 3 to 15 μm is desirable while not being limited to this. A mixing ratio of the toner and the carrier may be regulated in such a manner that a desired toner charging amount can be obtained. A toner ratio is suitably set to 3 to 30% by weight with respect to a total amount of the toner and the carrier, and is preferably set to 4 to 20% by weight.

Figure 2:
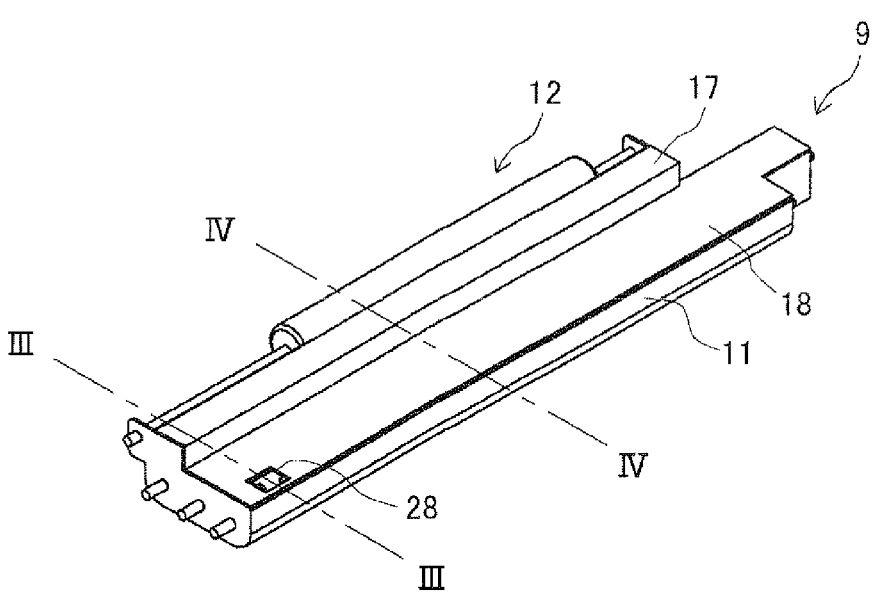
FIG. 2 is a perspective view of a developing apparatus according to the present invention.
Figure 5:
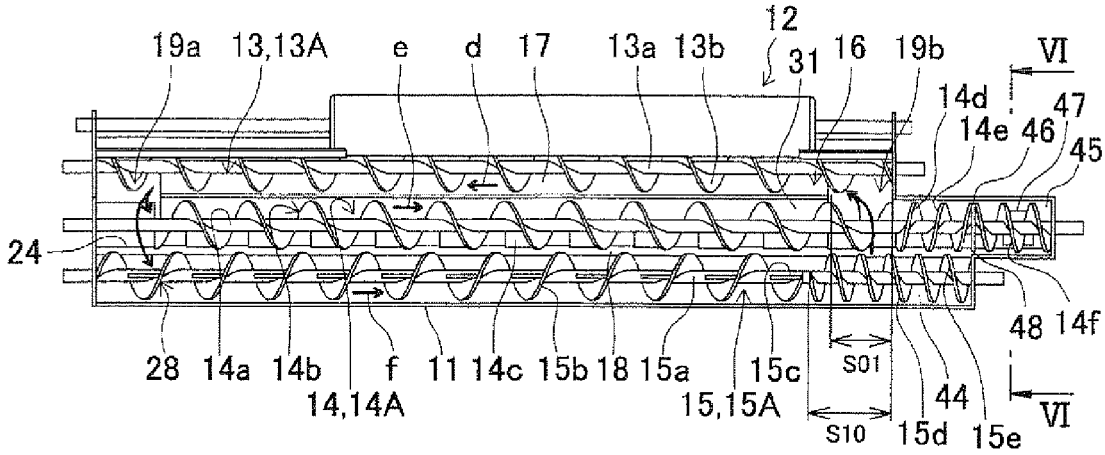
FIG. 5 is a top view of the developing apparatus according to the present invention.

Subsequently, a description will be given in detail of the developing apparatus 9. FIGS. 2 and 5 show the developing apparatus 9 of a so-called trickle type image forming apparatus structured such as to particularly replenish the developer including a small amount of carrier in addition to the toner, in an electrophotographic type using the two-component developer. The housing 11 of the developing apparatus 9 is formed into a long box shape extending from one end side to the other end side, and an inner portion thereof is divided into two sections including a developer supplying and recovering portion 17 and a developer agitating portion 18 by a partition wall 16 extending in a longitudinal direction. In this case, both end sides of the developer supplying and recovering portion 17 and the developer agitating portion 18 are communicated with each other by communication portions 19*a* and 19*b*, respectively, and can move in a circulating manner the developer within the housing 11. In other words, the developer supplying and recovering portion 17 and the developer agitating portion 18 are provided so as to be adjacent via the partition wall 16 having the communication portions 19*a* and 19*b*. Further, the developer supplying and recovering portion 17 and the developer agitating portion 18 form a circulating conveying path through the communication portions 19*a* and 19*b*.

The developing apparatus 9 is provided with a braking portion 44 inhibiting a discharge of the developer on a downstream side in a developer conveying direction mentioned below in a range in which the communication portion 19*b* of the developer agitating portion 18 is positioned. The braking portion 44 is continued to the developer agitating portion 18 in conveying paths 14A and 15A mentioned below.

Figure 6:
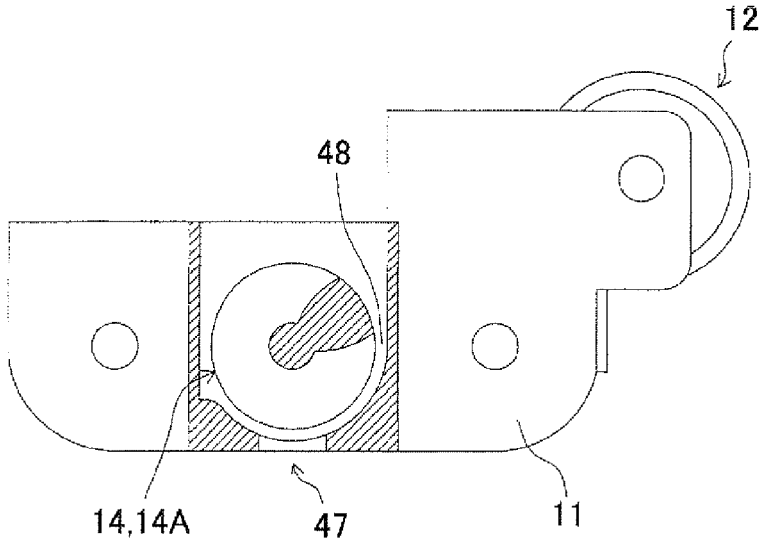
FIG. 6 is a cross sectional view along a line VI-VI in FIG. 5.

The developing apparatus 9 is provided with a discharge portion 45 in such a manner as to extend to a downstream side of the braking portion 44 in the conveying path 14A of the first agitating screw 14. The braking portion 44 and the discharge portion 45 are continued to the developer agitating portion 18. The structure is made such as to convey only a part of an excess amount of developer on the downstream side of the developer agitating portion 18 to the discharge portion 45 by providing the discharge portion 45 in the conveying path 14A of the first agitating screw 14. As shown in FIGS. 5 and 6, the discharge portion 45 is provided with a developer discharge port 47 discharging a part of the excess amount of developer on the downstream side of the developer agitating portion 18 coming over the braking portion 44. Appropriately discharging the developer through the developer discharge port 47 prevents the deteriorated carrier from staying within the housing 11 for a long period. The developer discharged from the developer discharge port 47 is conveyed to a discharge and storage portion (not shown).

Figure 4:
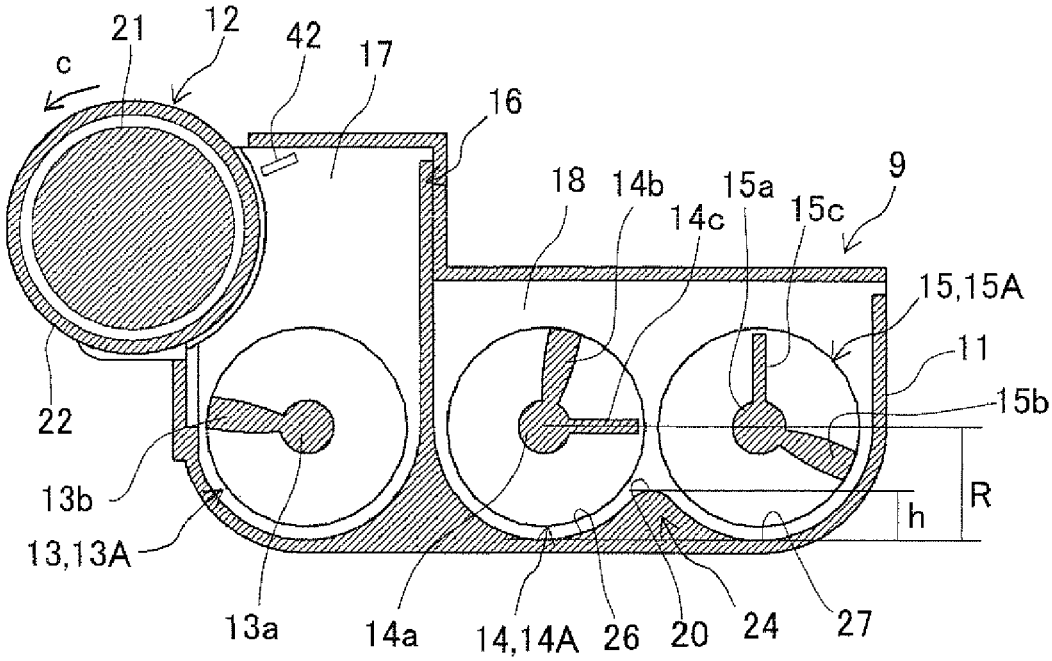
FIG. 4 is a cross sectional view along a line IV-IV in FIG. 2.

The developing roller 12 is provided on an opposite side to the developer agitating portion 18 in the developer supplying and recovering portion 17, and is structured such as to attach the toner to the photoconductor drum 7 arranged so as to be opposed and develop the electrostatic latent image on the photoconductor drum 7. As shown in FIG. 4, the developing roller 12 is constructed by a fixedly arranged magnet roller 21 and a rotatable sleeve roller 22 inside enveloping the magnet roller 21. The magnet roller 21 has five magnetic poles including N1, S2, N2, N3 and S1 which are not illustrated, along a rotating direction of the sleeve roller 22. The sleeve roller 22 of the developing roller 12 is set in such a manner as to have the same rotating direction c (an opposite direction to each other in the opposed portions) as a rotating direction b of the photoconductor drum 7. In the developer supplying and recovering portion 17, a regulating member 42 regulating a layer thickness of the toner on the developing roller 12 is arranged.

The conveying screw 13 is arranged in the developer supplying and recovering portion 17 in such a manner as to extend along the direction of the rotating axis of the developing roller 12. The conveying screw 13 is provided with a spiral impeller blade 13*b* around a rotating shaft 13*a*. The impeller blade 13*b* is provided in a direction that the developer is conveyed from the communication portion 19*b* side to the communication portion 19*a* side if the conveying screw 13 is rotated. The conveying screw 13 is structured such as to convey the developer in a longitudinal direction (from the communication portion 19*b* side to the communication portion 19*a* side as shown by an arrow "d" in FIG. 5) as well as directly or indirectly supplying the developer to the developing roller 12. Further, the conveying screw 13 is structured such as to convey the developer to the developer agitating portion 18 through the communication portion 19*a*. The developer supplying and recovering portion 17 in which the conveying screw 13 is arranged forms a conveying path 13A.

The first agitating screw 14 is arranged in a range of the developer agitating portion 18, the braking portion 44 and the discharge portion 45 in such a manner as to extend along the direction of the rotating axis of the conveying screw 13 adjacent to the partition wall 16. The first agitating screw 14 is provided with a spiral impeller blade 14*b* serving as a forward wound impeller blade in the periphery of the rotating shaft 14*a* in the range of the developer agitating portion 18. The impeller blade 14*b* is provided in a direction that the developer is conveyed from the communication portion 19*a* side to the communication portion 19*b* side if the first agitating screw 14 is rotated. Further, a backward wound portion 14*d* is provided in the range of the braking portion 44. The backward wound portion 14*d* is constructed by a backward wound impeller blade 14*e* which is backward wound with respect to the impeller blade 14*b* serving as the forward wound impeller blade. Further, the backward wound impeller blade 14*e* is formed in such a manner that a pitch becomes smaller in comparison with the impeller blade 14*b*. A disc 46 in a direction which is orthogonal to the developer conveying direction is provided in a boundary portion between the discharge portion 45 and the braking portion 44 serving as an upstream side in the developer conveying direction of the first agitating screw 14. Further, the braking portion 44 is provided with a backward wound portion 14*d* on an upstream side in the developer conveying direction of the disc 46. An outer diameter of the disc 46 is the same as an outer diameter of the impeller blade 14*b*. A gap 48 is provided between the disc 46 and the conveying path 14A. A forward wound impeller blade 14*f* which is backward wound with respect to the backward wound impeller blade 14*e* is provided in a range of the discharge portion 45 of the first agitating screw 14. The forward wound impeller blade 14*f* is formed in such a manner that a pitch becomes smaller in comparison with the impeller blade 14*b*. The backward wound portion 14*d* is structured such as to brake the developer with respect to the conveying direction of the developer. The forward wound impeller blade 14*f* of the discharge portion 45 is structured such as to convey the developer in the discharge portion 45 from the disc 46 side to the developer discharge port 47 side. On an upstream side in the developer conveying direction of the impeller blade 14*b* is provided a rib 14*c* (illustrated in FIGS. 3 and 4) protruding in a diametrical direction from the rotating shaft 14*a*. A side edge of the rib 14*c* is firmly attached to the impeller blade 14*b*. The rib 14*c* is structured such as to deliver the developer in a direction which is orthogonal to the axial direction of the rotating shaft 14*a*, if the first agitating screw 14 is rotated. In the present embodiment, the rib 14*c* is formed into a rectangular tabular shape, and has width: 15 mm, height: (outer diameter of first agitating screw 14)−1 mm, and thickness: 2 mm. All the ribs 14*c* of the first agitating screw 14 are arranged on the same plane which is in parallel to the direction of the rotating axis of the first agitating screw 14. The rotating direction of the first agitating screw 14 is a direction in which the developer is conveyed from the below to the above in the portion which is opposed to the second agitating screw 15. The first agitating screw 14 is structured such as to deliver the developer in the conveying path 14A of the first agitating screw 14 to the conveying path 15A of the second agitating screw 15 over a guide 24 mentioned below while agitating, and convey the developer in an inverse direction (a longitudinal direction heading for the communication portion 19*b* side from the communication portion 19*a* side, as shown by an arrow "e" in FIG. 5) to the conveying direction by the conveying screw 13. Further, the first agitating screw 14 is structured such as to deliver the developer to the developer supplying and recovering portion 17 through the communication portion 19*b*.

The second agitating screw 15 is arranged in the developer agitating portion 18 and the braking portion 44 on an opposite side to the conveying screw 13 of the first agitating screw 14 in such a manner as to extend along the direction of the rotating axis of the first agitating screw 14. The second agitating screw 15 is provided with a spiral impeller blade 15*b* in the periphery of the rotating shaft 15*a*. The impeller blade 15*b* is provided in such a manner that the developer is conveyed in the same direction (a direction heading for the communication portion 19*b* side from the communication portion 19*a* side, as shown by an arrow "f" in FIG. 5) as the conveying direction by the first agitating screw 14, if the second agitating screw 15 is rotated. A backward wound portion 15*d* is arranged in a range S10 including the communication portion 19*b* on a downstream side in the conveying direction of the second agitating screw 15 and an upstream side of the communication portion 19*b*, and the braking portion 44. The range of the communication portion 19*b* in this case is S01, and the range including the communication portion 19*b* and the upstream side of the communication portion 19*b* is S10. The backward wound portion 15*d* is constructed by a backward wound impeller blade 15*e* which is backward wound with respect to the impeller blade 15*b* serving as the forward wound impeller blade. Further, the backward wound impeller blade 15*e* is formed in such a manner that a pitch becomes smaller in comparison with the impeller blade 15*b*. The backward wound portion 15*d* is structured such as to brake the developer with respect to the conveying direction of the developer. On an upstream side in the developer conveying direction of the impeller blade 15*b* is provided a tabular rib 15*c* (illustrated in FIGS. 3 and 4) protruding in a diametrical direction from the rotating shaft 15*a*. A side edge of the rib 15*c* is firmly attached to the impeller blade 15*b*. The rib 15*c* is structured such as to deliver the developer in a direction which is orthogonal to the axial direction of the rotating shaft 15*a*, if the second agitating screw 15 is rotated. In the present embodiment, the rib 15*c* is formed into a rectangular tabular shape, and has width: 15 mm, height: (outer diameter of second agitating screw 15)−1 mm, and thickness: 2 mm. All the ribs 15*c* of the second agitating screw 15 are arranged on the same plane which is in parallel to the direction of the rotating axis of the second agitating screw 15. The rotating direction of the second agitating screw 15 is a direction in which the developer is conveyed from the below to the above in the portion which is opposed to the first agitating screw 14. In other words, the rotating directions of the first agitating screw 14 and the second agitating screw 15 are the direction in which the developer is conveyed from the below to the above in the opposed portions to each other. The second agitating screw 15 is structured such as to deliver the developer in the conveying path 15A of the second agitating screw 15 to the conveying path 14A of the first agitating screw 14 over the guide 24 while agitating, and convey the developer in an inverse direction (a longitudinal direction heading for the communication portion 19*b* side from the communication portion 19*a* side, as shown by an arrow "f" in FIG. 5) to the conveying direction by the conveying screw 13. Further, the second agitating screw 15 is structured such as to deliver the developer to the developer supplying and recovering portion 17 through the communication portion 19*b*.

The projection shaped guide 24 is arranged in an inner bottom surface 27 of the housing 11 positioned between the first agitating screw 14 and the second agitating screw 15, from one side to the other side in the direction of the rotating axis of the first agitating screw 14 and the second agitating screw 15. A cross sectional shape of the guide 24 orthogonal to the axial direction of the rotating shafts 14*a* and 15*a* of the agitating screws 14 and 15 is a mountain shape with a wide foot portion 26. The guide 24 is arranged in such a manner that the gaps between the outermost portions 23 of the first agitating screw 14 and the second agitating screw 15, and the inner bottom surface 27 of the housing 11 and the guide 24 are 1.5 mm or more and 3 mm or less. In the present embodiment, the gap is 1.5 mm. On the assumption that a height from the inner, bottom surface 27 of the housing 11 to the top portion 20 of the guide 24 is set to "h", and a distance between the centers of the shafts 14*a* and 15*a* of the first agitating screw 14 and the second agitating screw 15 and the inner bottom surface 27 of the housing 11 is set to "R", a relationship $0.2\times R<h<1.2\times R$ is established. The conveying path 14A of the first agitating screw 14 is formed on the side in which the first agitating screw 14 is arranged, and the conveying path 15A of the second agitating screw 15 is formed on the side in which the second agitating screw 15 is arranged.

Figure 3:
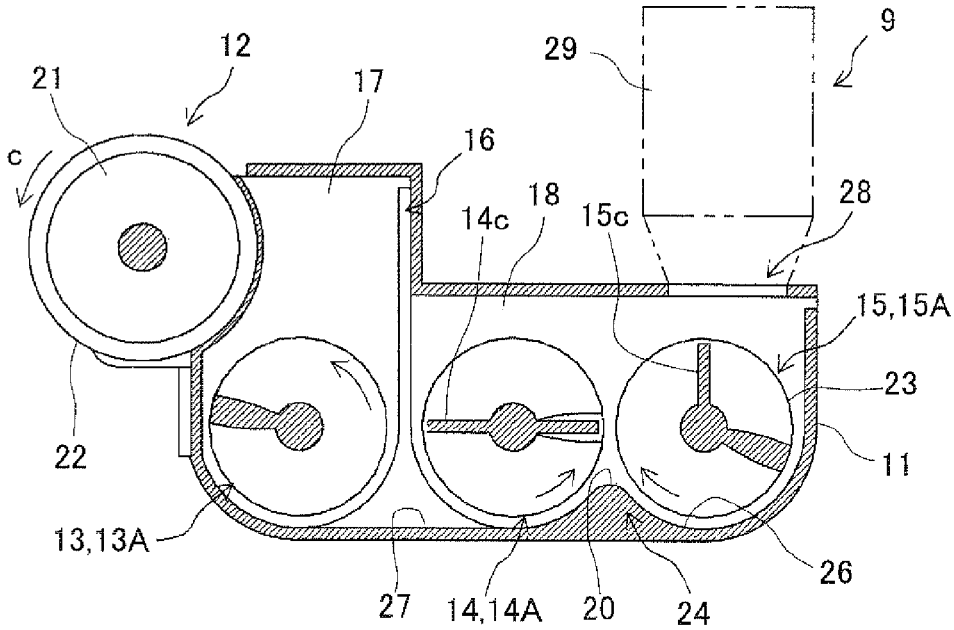
FIG. 3 is a cross sectional view along a line III-III in FIG. 2.

A developer replenishing port (a toner supplying opening portion) 28 is provided in the upper surface of the housing 11 above the second agitating screw 15 on the side close to the communication portion 19*a* of the conveying path 15A of the second agitating screw 15. As shown in FIG. 3, the developer is replenished to the developer replenishing port 28 from a hopper 29 mentioned below.

A toner concentration sensor 31 is provided as means for detecting a toner amount per unit volume, on a downstream side in the developer conveying direction of the developer agitating portion 18. The toner concentration sensor 31 is a conventionally well-known device which outputs a difference of magnetic permeability of the developer (an iron content included in the carrier) as a frequency, and calculates the toner concentration (a weight rate of the toner with respect to the developer).

The conveying screw 13, the first agitating screw 14 and the second agitating screw 15 are structured such as to be rotated by a driving force from a motor (not shown). The first agitating screw 14 and the second agitating screw 15 are structured such that gears (not shown) provided respectively in the end portions of the rotating shafts 14*a* and 15*a* protruding from the housing 11 are engaged with each other, and synchronously rotate.

(Operation)

Next, operation of the image forming apparatus structured as mentioned above will be described.

At a time of forming an image, color image data obtained by reading an image or image data outputted from a personal computer or the like is transmitted as image signals of the respective colors yellow (Y), magenta (M), cyan (C) and black (Bk) to each of the image forming unit 1 after a predetermined signal process is applied thereto.

In each of the image forming units 1, a laser light which is modulated is projected onto each of the photoconductor drums 7 to form an electrostatic latent image. Further, the toner is supplied to the photoconductor drum 7 from the developing apparatus 9.

In the developing apparatus 9, the developer accommodated within the housing 11 is circulated while being agitated, by rotationally driving the first agitating screw 14 and the second agitating screw 15. Further, the developer is supplied from the conveying screw 13 to the developing roller 12. The developer is scraped off by the regulating member 42 so as to be a fixed amount, and is fed to the photo conductor drum 7.

Accordingly, the toner images of yellow, magenta, cyan and black are formed on the respective photoconductor drums 7. The formed toner images of yellow, magenta, cyan and black are subsequently overlapped on the moving intermediate transfer belt 6 by the primary transfer portion 34 so as to be primarily transferred. The overlapped toner image formed on the intermediate transfer belt 6 as mentioned above moves to the secondary transfer portion 35 according to the movement of the intermediate transfer belt 6.

Further, the recording medium 37 is supplied from the paper feed unit 4. The supplied recording medium 37 is conveyed between the second transfer portion 35 and the intermediate transfer belt 6 by the conveying roller 38, and the toner image formed on the intermediate transfer belt 6 is transferred to the recording medium 37. The recording medium 37 to which the toner image is transferred is conveyed further to the fixing unit 39, where the transferred toner image is fixed. After that, the recording medium 37 is discharged to the discharge tray 40.

Next, agitation and circulation of the developer of the developing apparatus 9 according to the present embodiment will be described with reference to FIG. 3. The developer replenished from the developer replenishing port 28 falls to the second agitating screw 15. Since the rotating direction of the second agitating screw 15 is the direction in which the developer is conveyed from the below to the above in the portion opposed to the first agitating screw 14, the replenished developer is conveyed from the above to the below along the housing 11 on the opposite side to the first agitating screw 14 by the second agitating screw 15. Thereafter, the developer goes over the guide 24 so as to be delivered to the conveying path 14A of the first agitating screw 14, and is also conveyed in the longitudinal direction (the direction of the arrow "f" in FIG. 5) while being agitated within the developer conveying path 15A. Further, the developer goes over the guide 24 so as to be delivered to the conveying path 15A of the second agitating screw 15, and is also conveyed in the longitudinal direction (the direction of the arrow "e" in FIG. 5) while being agitated within the developer conveying path 14A. As mentioned above, the developer within the developer conveying paths 14A and 15A is agitated and conveyed by the first agitating screw 14 and the second agitating screw 15. In this case, the guide 24 existing between the first agitating screw 14 and the second agitating screw 15 is provided with an assisting function of delivering the developer from the developer conveying path 15A to the developer conveying path 14A and vice versa as well as a function of assisting in the improvement of the speed at a time of conveying the developer in the longitudinal direction. The first agitating screw 14 and the second agitating screw 15 rotate from the below to the above in the opposed portions to each other, and the developer is conveyed in a rotating direction along the guide 24 while obtaining a propelling force based on the rotating motions of the ribs 14*c* and 15*c*. Accordingly, it is possible to well agitate the developer.

In the conveying path 14A, since the first agitating screw 14 has the backward wound portion 14*d* in the range of the braking portion 44, the developer is braked with respect to the conveying direction by the braking portion 44. Further, in the conveying path 15A, since the second agitating screw 15 has the backward wound portion 15*d* in the range S10, the developer is braked with respect to the conveying direction in S10. Further, the braked developer is pushed out by the subsequently conveyed developer so as to be delivered to and join the developer conveying path 14A. Further, the developer conveyed by the first agitating screw 14 and the second agitating screw 15 is delivered to the developer supplying and recovering portion 17 (the conveying path 13A on the upstream side of the developer conveying direction of the conveying screw 13) by the communication portion 19*b* on the downstream side of the developer conveying direction. Since a force which the housing 11 of the developing apparatus 9 receives in the developer conveying direction, and a force which the second agitating screw 15 receives are lightened by the backward wound portion 15*d*, it is possible to reduce a torque necessary for driving the developing apparatus 9.

As mentioned above, in the developer conveying paths 14A and 15A, the developer is braked by the backward wound portions 14*d* and 15*d* of the first agitating screw 14 and the second agitating screw 15. Out of the developer as a result of joining the developer on the conveying path 14A of the first agitating screw 14 with the developer on the conveying path 15A of the second agitating screw 15 on the downstream side in the developer conveying direction, a part thereof goes into the braking portion 44 without being delivered to the conveying path 13A on the upstream side in the developer conveying direction of the conveying screw 13. Further in the conveying path 14A, the developer is braked by the backward wound portion 14*d* on the upstream side of the disc 46 of the first agitating screw 14. Then, the developer is dammed in front of the discharge portion 45 by the disc 46 so as to be reserved in the braking portion 44. However, if a fixed amount of developer is reserved in the braking portion 44 and the developer is thereafter conveyed further, the developer goes over the disc 46 so as to go forward to the discharge portion 45 from the gap 48. In other words, the developer in the developer conveying path 14A goes over the braking portion 44 so as to be conveyed to the discharge portion 45. The developer conveyed to the discharge portion 45 is discharged from the developer discharge port 47. The developer is not reduced until the developer beyond the certain fixed amount is conveyed to the braking portion 44. Since the developer conveyed along the developer conveying path 15A flows into the communication portion 19*b* after being delivered to the developer conveying path 14A, the developer exists more on the developer conveying path 14A side than on the developer conveying path 15A side, on the downstream side of the conveying paths 14A and 15A. Accordingly, even in the case that the developer within the conveying paths 14A and 15A is too much, the developer can be discharged more quickly in case of the present structure in which the discharge portion 45 is installed on the downstream side of the developer conveying path 14A, in comparison with the case that the discharge portion 45 is installed on the downstream side of the developer conveying path 15A, whereby it is possible to avoid the clogging of the excess developer and the occurrence of the problem.

The developer which can be sufficiently agitated and conveyed and be normally charged in the developing apparatus 9 is conveyed in the longitudinal direction while being supplied to the developing roller 12 within the developer conveying path 13A. The developer conveyed by the conveying screw 13 is delivered to the developer conveying path 14A from the developer conveying path 13A through the communication portion 19*a* on the downstream side in the developer conveying direction. Further, the developer goes over the guide 24 to be delivered to the conveying path 15A of the second agitating screw 15 from the conveying path 14A of the first agitating screw 14. In this manner, the circulating property of the developer in the developing apparatus 9 is secured.

On the other hand, in the developing apparatus 9, the toner concentration is detected by the toner concentration sensor 31 on the downstream side in the developer conveying direction of the developer agitating portion 18. Further, a developer replenishing amount is decided based on the toner concentration and the image information at a time of forming the image, and the developer is replenished from the hopper 29 in which the developer is filled to the developer replenishing port 28.

Experimental examples for confirming an effect whether or not a good image can be obtained without deteriorating the image quality even if the high printing images succeed in the developing apparatus 9 according to the present invention and the image forming apparatus provided with the same will be described.

Experimental conditions are as described in FIGS. 7 to 12 and FIGS. 14 and 17. With regard to the image forming apparatus, the conveying screw (the agitating member) 13 was structured such as to have an outer diameter ϕ30 and a rotating speed 400 rpm, the first agitating screw (the first agitating member) 14 was structured such as to have an outer diameter ϕ30 and a rotating speed 300 rpm, the second agitating screw (the second agitating member) 15 was structured such as to have an outer diameter ϕ30 and a rotating speed 300 rpm, and an inner diameter of each of the screws 13, 14 and 15 was set to 8 mm. A distance between the impeller blade 14*b* of the first agitating screw 14 and the impeller blade 15*b* of the second agitating screw 15 was set to 2 mm, and a distance between the bottom surface (the inner bottom surface) 27 and the impellers 14*b* and 15*b* was set to 1.5 mm. A height of the guide 24 was set to h in a height from the inner bottom surface 27 of the housing 11 to the top portion 20 of the guide 24, and a distance from the centers of two agitating shafts 14*a* and 15*a* to the inner bottom surface 27 of the housing 11 was set to R. A rotating direction of the first agitating screw 14 and the second agitating screw 15 was set to a direction from the below to the above in the portion opposed to each other. The replenishing position of the developer was set to a portion between the first agitating screw 14 and the second agitating screw 15 (between two shafts). In the drawing, "wall side" indicates the second agitating screw 15 side. As a discharge position, "rear of first agitating" indicates the discharge portion 45 of the conveying path 14A of the first agitating screw 14, and "rear of second agitating) indicates the discharge portion of the conveying path 15A of the second agitating screw 15. The experiment was carried out under the conditions mentioned above. With regard to whether or not the image is good, the concentration unevenness was determined by visually checking the image at a time of continuously printing five sets, each set having an output condition 100 ppm, continuous one hundred A4 sheets with printing rate 100% and ten sheets with printing rate 0%. With regard to the concentration unevenness, mark "x" was applied to the case in which the unevenness is apparently recognized, mark "Δ" was applied to the case in which it is slightly recognized, and mark "○" was applied to the case in which it is never recognized.

Experimental Example 1

FIG. 7 shows the presence or absence of the developer leakage, and the presence or absence of the concentration unevenness with regard to the images which were printed by changing the height of the guide 24 of the housing 11. When the developer discharge port 47 was provided in the discharge portion 45 of the conveying path 15A of the second agitating screw 15, the generation of the developer leakage was recognized, however, it was recognized that the developer leakage was not generated when providing the developer discharge port 47 in the discharge portion 45 of the conveying path 14A of the first agitating screw 14. The concentration unevenness became "○" in the range from 0.2R to 1.2R of the height of the guide 24, and a good image could be obtained. However, the concentration unevenness became "x" in 0.1R and 1.3R, and the good image could not be obtained. In other words, it was confirmed that in the case that the guide 24 of the housing 11 had the heights 0.1R and 1.3R, since the delivery of the developer was not carried out between the first agitating screw 14 and the second agitating screw 15 even if the replenished developer was well incorporated, the deflection was generated in the developer, high and low concentrations appeared in the image, resulting in the concentration unevenness.

Experimental Example 2

In FIG. 8, the same experimental conditions as the conditions shown in FIG. 7 were employed except that the outer diameter of each of the screws 13, 14 and 15 was changed to ϕ20 mm, the distance between the impeller blades and the distance between the bottom surface and the impeller blades were set to the same as the experimental example 1. It was confirmed that the same relationship was established even if the outer diameter of each of the screws 13, 14 and 15 was changed from ϕ30 to ϕ20.

Experimental Example 3

FIG. 9 shows the presence or absence of the concentration unevenness with regard to the printed images in the case of setting the height of the guide 24 to 0.2R (a threshold value in which the screw unevenness was not generated in FIG. 7), and changing the distance between the bottom surface (the inner bottom surface) 27 and the impeller blades 14*b* and 15*b*. Even if the distance between the bottom surface 27 of the housing 11 and each of the screws 14 and 15 was changed to 3 mm, the concentration unevenness became "○" in the same manner as the case of 1.5 mm, and the good image could be obtained. However, in the case of changing to 5 mm, the concentration unevenness became "x", and the good image could not be obtained.

Experimental Example 4

FIG. 10 shows a result obtained by changing the rotating speed of the conveying screw 13 from 400 rpm to 800 rpm. The concentration unevenness became "○" in all the range from 400 rpm to 800 rpm, and the good image could be obtained. The rotating speed is not limited to the above range.

Further, it was confirmed that the same effect could be obtained even by using the developer having the carrier particle diameter 20 μm, 40 μm or 60 μm in place of the carrier particle diameter 50 μm. The developer is not limited to the above range.

According to the result mentioned above, in the case that the excess amount of developer circulates in the circulating conveying path, with the discharge portion 45 provided in the conveying path 14A of the first agitating screw 14 so that a part of the excess amount of developer is discharged from the developer discharge port 47 of the discharge portion 45, on the downstream side of the developer agitating portion 18, it is possible to avoid the excess amount of developer being delivered into the developer supplying and recovering portion 17, and prevent a packing of the developer, a leak of the developer within the developing apparatus 9, and a breakage of the developing apparatus 9 or so.

It is possible to well agitate the developer by rotating the first agitating screw 14 and the second agitating screw 15 in such a manner that the developer is conveyed from the below to the above in the portion in which the rotating directions of the first agitating screw 14 and the second agitating screw 15 are opposed to each other, forming the shape of the guide 24 in such a manner as to satisfy the relationship $0.2\times R<h<1.2\times R$, on the assumption that h is the height from the inner bottom surface 27 of the housing 11 to the top portion 20 of the guide 24, and R is the distance between the centers of the shafts 14*a* and 15*a* of the first agitating screw 14 and the second agitating screw 15 and the inner bottom surface 27 of the housing 11, arranging the first agitating screw 14 and the second agitating screw 15 in such a manner that the gap between the respective outermost portions 23 thereof and the inner bottom surface 27 of the housing 11 and the guide 24 becomes 1.5 mm or more and 3 mm or less, and forming the cross sectional shape which is orthogonal to the axial direction of the rotating shafts 14*a* and 15*a* of the guide 24 as the mountain shape with a wide foot portion 26. Further, it is possible to well circulate the developer within the circulating conveying path through the communication portions 19*a* and 19*b*. In the developer supplying and recovering portion 17, since the developer which is well agitated and sufficiently charged is sufficiently supplied to the developing roller 12, it is possible to obtain the good image without deteriorating the image quality even if the high printing images are continuously provided.

Experimental Example 5

FIG. 11 shows a change of a rotational torque in the case that the backward wound portion 15*d* is provided in the range including the communication portion 19*b* on the downstream side in the developer conveying direction of the second agitating screw 15 and the upstream side of the communication portion 19*b*. This was compared with a reference developing apparatus. The expression of "to communication portion" indicates that the backward wound position was in the range S01 (see FIG. 5). The expression of "over communication portion" indicates that the backward wound position was in the range of S10. In the present embodiment, S01 is 40 mm, and S10 is 50 mm. it can be confirmed that if the backward wound portion 15*d* was provided "to communication portion", that is, in the range S01, the rotational torque was 10% reduced with reference to the reference, and if it was provided "over communication portion", that is, in the range S10, it was 20% reduced.

From the results mentioned above, according to the present invention, it is possible to reduce the torque which is necessary for driving the developing apparatus 9, by arranging the backward wound portion 15*d* in the range including the communication portion 19*b* on the downstream side in the developer conveying direction of the second agitating screw 15 and the upstream side of the communication portion 19*b*.

Experimental Example 6

FIG. 12 shows the presence or absence of a concentration unevenness with regard to the printed image in the case that the height of the guide 24 is 0.1R (the threshold value in which the screw unevenness is generated in FIG. 7), and the ribs 14*c* and 15*c* are provided in the rotating shafts 14*a* and 15*a* of the first agitating screw 14 and the second agitating screw 15.

Figure 13:
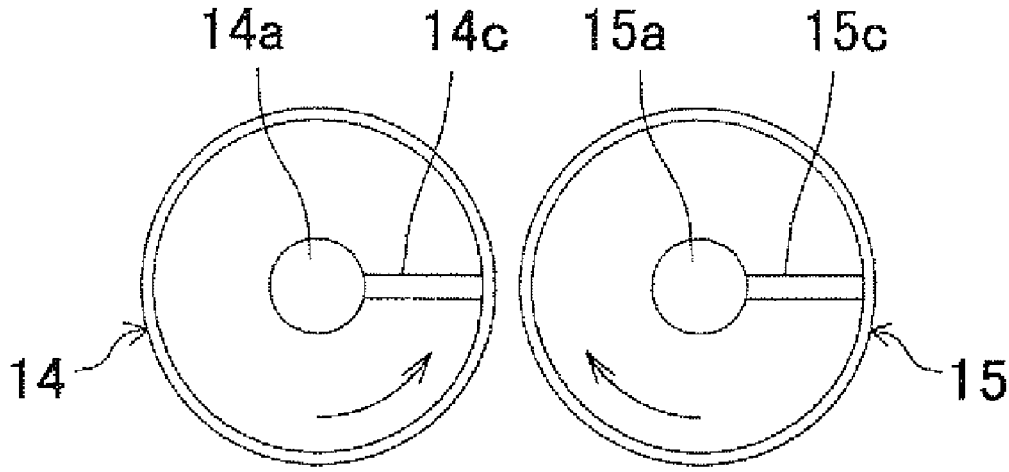
FIG. 13 is a view showing positions of ribs of a first agitating member and a second agitating member.

In this case, the expression of "rib 0 degree" of the second agitating screw 15 indicates a state as shown in FIG. 13 in which the rib 14*c* of the first agitating screw 14 exists at a position of 0 degree at rest (a direction heading for the rotating shaft 15*a* from the rotating shaft 14*a* on a surface connecting the centers of the rotating shaft 14*a* and the rotating shaft 15*a* in the case of viewing the rotating shaft 14*a* from the communication portion 19*a* side), and in which the leading end of the rib 15*c* of the second agitating screw 15 protrudes from the rotating shaft 15*a* in the same direction as the leading end of the rib 14*c* of the first agitating screw 14. When the rotating speed is same, the ribs 14*c* and 15*c* come to this position every rotating cycle.

In the case that the height of the guide 24 was 0.1R, and none of the first agitating screw 14 and the second agitating screw 15 was provided with the ribs 14*c* and 15*c*, the concentration unevenness became "x", and the good image could not be obtained. However, in the case that the rib 14*c* or 15*c* was provided in any one of the first agitating screw 14 and the second agitating screw 15, or the ribs 14*c* and 15*c* were provided in the state of "rib 0 degree" in both of the first agitating screw 14 and the second agitating screw 15, the concentration unevenness became "Δ", and it was confirmed that the effect for obtaining the good image existed.

Experimental Example 7

FIG. 14 shows the presence or absence of the concentration unevenness generated by difference of the rotating speed of the first agitating screw 14 and the second agitating screw 15, and the set positions of the ribs 14*c* and 15*c*.

Figure 15:
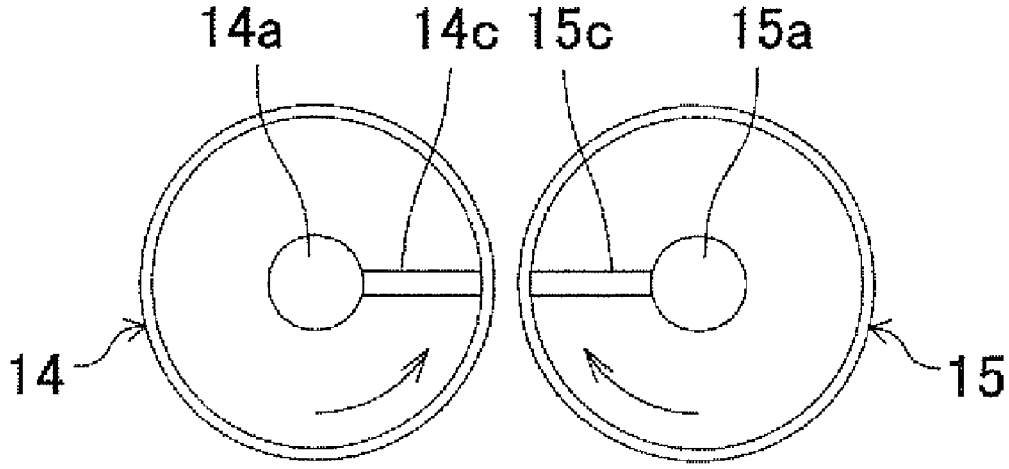
FIG. 15 is a view showing positions of ribs of a first agitating member and a second agitating member.
Figure 16A:
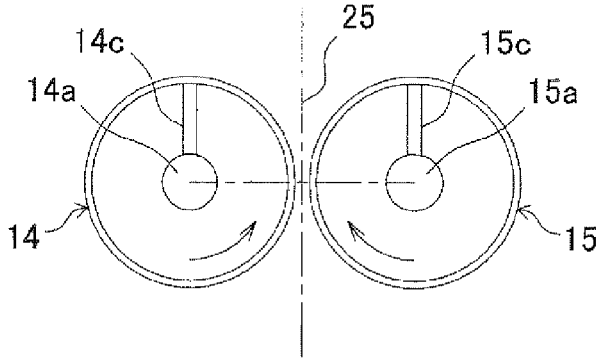
FIGS. 16A to 16D are views showing positions of ribs arranged symmetrically with respect to a surface which is orthogonal to a surface connecting axes of respective rotating axes of the first agitating member and the second agitating member.
Figure 16B:
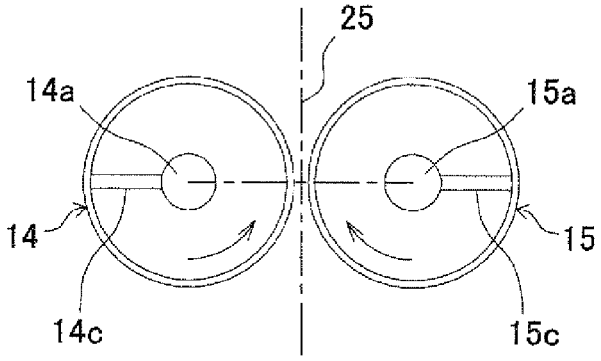
Figure 16C:
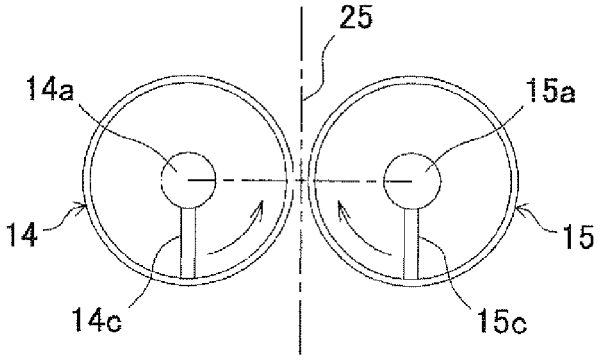
Figure 16D:
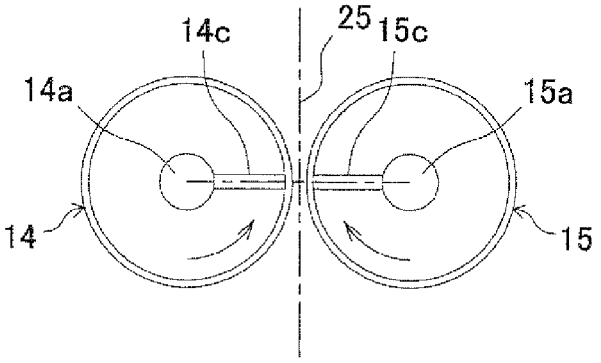

In this case, as shown in FIG. 15, the expression of "rib 180 degrees" indicates a state in which the position of the rib 15*c* of the second agitating screw 15 was deviated at 180 degrees from the "rib 0 degree" mentioned above. When the rotating speed is the same, the ribs 14*c* and 15*c* come to this position every rotating cycle.

In the case that both of the first agitating screw 14 and the second agitating screw 15 rotated at 300 rpm, and the set position of the rib 15*c* at rest was "rib 0 degree", the concentration unevenness became "Δ", and it was confirmed that the effect for obtaining the good image existed. Further, in the case that both of the first agitating screw 14 and the second agitating screw 15 rotated at 300 rpm, and the set position of the rib 15*c* at rest was "rib 180 degrees", the concentration unevenness became "x", and the good image could not obtained. Further, in the case that the first agitating screw 14 rotated at 300 rpm, the second agitating screw 15 rotated at 360 rpm, and the set position of the rib 15*c* at rest was "rib 180 degrees", the concentration unevenness became "Δ", and it was confirmed that the effect for obtaining the good image existed.

As shown in FIGS. 16A to 16D, if the respective ribs 14*c* and 15*c* of the first agitating screw 14 and the second agitating screw 15 are arranged symmetrically with each other at rest with respect to the surface 25 which is orthogonal to the surface connecting the axes of the rotating shafts 14*a* and 15*a*, the delivery of the developer to the adjacent conveying paths 14A and 15A is blocked undesirably in the case that the first agitating screw 14 and the second agitating screw 15 are rotated at the same rotating speed. Accordingly, the arrangement mentioned above (FIGS. 16A to 16D) should be avoided. In the arrangement other than FIGS. 16A to 16D, at the same position in the axial direction, there is no case where the first agitating screw 14 and the second agitating screw 15 scoop up the developer at the same timing and collide the developer with each other at the same timing, the delivery of the developer to the adjacent conveying paths 14A and 15A is not blocked. If the second agitating screw 15 is prevented from coming to the "rib 180 degrees" shown in FIG. 16D with respect to the first agitating screw 14 in the manner as mentioned above, the concentration unevenness does not come to "x", and there can be obtained the effect for obtaining the good image. In this case, the respective ribs 14*c* and 15*c* of the first agitating screw 14 and the second agitating screw 15 may be arranged at the deviated positions without being arranged at the same position in the axial direction of the rotating shafts 14*a* and 15*a*.

Experimental Example 8

FIG. 17 shows the presence or absence of the concentration unevenness caused by a difference between the case that the developer replenishing port 28 was provided between the first agitating screw 14 and the second agitating screw 15 and the case that the developer replenishing port 28 was provided at the second agitating screw 15 side, in the case that the height of the guide 24 is 0.1R (the threshold value in which the screw unevenness is generated in FIG. 7). In the case that the developer replenishing port 28 was provided between the first agitating screw 14 and the second agitating screw 15 (between two shafts), and the ribs 14*c* and 15*c* were not provided in the first and second agitating screws 14 and 15, the concentration unevenness became "x", and the good image could not be obtained. However, in the case that they were provided at the second agitating screw 15 side (the wall side), that is, were provided above the second agitating screw 15, the concentration unevenness became "Δ", and it was confirmed that the effect for obtaining the good image existed. In FIGS. 7 to 12 and FIG. 14, the replenishing position of the developer was provided between the first agitating screw 14 and the second agitating screw 15, however, from the experimental results in FIG. 17, it was known that the better result could be obtained in the case that the replenishing position of the developer was provided at the second agitating screw 15 side.

In this case, the outer diameter of each of the screws 13, 14 and 15 and the relationship to the housing 11 are provided for carrying out the present embodiment, and the present invention is not limited to this. In this case, the rotating direction of the developing roller 12 may be set to any rotating direction. Further, the diameter of the developing roller 12 may be the same as the diameter of each of the screws 13, 14 and 15, or may be different from it. Further, the developer conveying amounts of the first agitating screw 14 and the second agitating screw 15 may be the same or different. Further, the applied bias may be the same or different. Further, the rotating speeds of the developing roller 12 and each of the screws 13, 14 and 15 may be the same or different.

In this case, the arrangement of the developer conveying paths 13A and 14A are not limited to be horizontal. The developer may fall down or lift up in a gravitational direction in the communication portions 19*a* and 19*b*.

Figure 18:
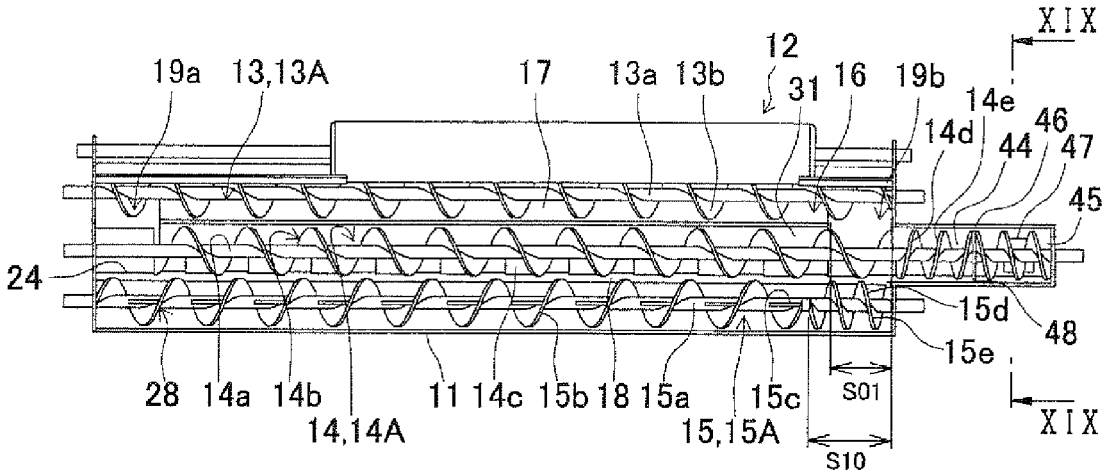
FIG. 18 is a top view showing another embodiment of the developing apparatus according to the present invention.
Figure 19:
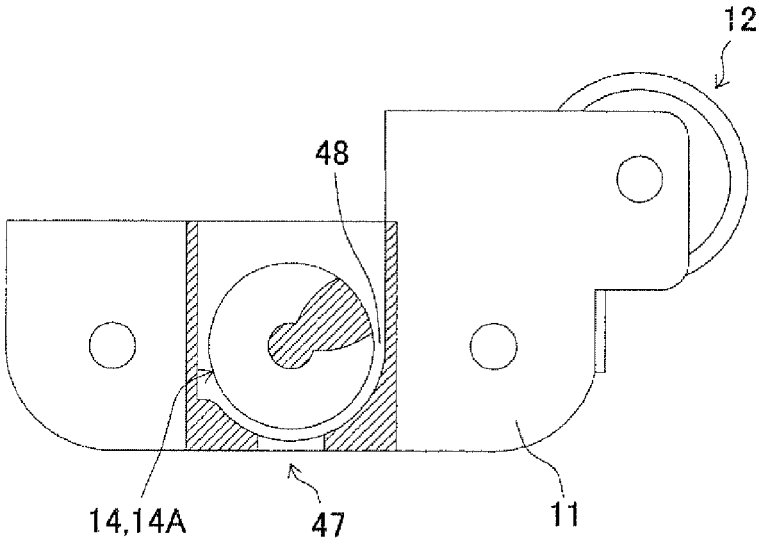
FIG. 19 is a cross sectional view along a line XIX-XIX in FIG. 18.

Further, as shown in FIG. 18, the braking portion 44 may not be provided in the conveying path 15A of the second agitating screw 15.

Although the present invention has been fully described by way of the examples with reference to the accompanying drawings, it is to be noted that various changes and modifications will be apparent to those skilled in the art. Therefore, unless such changes and modifications otherwise depart from the spirit and scope of the present invention, they should be construed as being included therein.

What is claimed is:

1. A developing apparatus, comprising:

a housing provided with a developer supplying and recovering portion and a developer agitating portion that are communicated with each other and form a circulating conveying path for a two-component developer including a toner and a carrier, so as to be adjacent via a partition wall having communication portions in both end portions;

a developer carrier provided on an opposite side to the developer agitating portion in the developer supplying and recovering portion, and attaching the toner to a photoconductor so as to develop an electrostatic latent image on the photoconductor;

a conveying member arranged in the developer supplying and recovering portion in such a manner as to extend along a direction of a rotating axis of the developer carrier, supplying the developer to the developer carrier, conveying the developer in a longitudinal direction, and delivering the developer to the developer agitating portion through the communication portion;

a first agitating member arranged in the developer agitating portion so as to extend along a direction of a rotating axis of the conveying member adjacent to the partition wall, conveying the developer in an inverse direction to the conveying direction by the conveying member while agitating, and delivering the developer to the developer supplying and recovering portion through the communication portion;

a second agitating member arranged in the developer agitating portion so as to extend along a direction of a rotating axis of the first agitating member adjacent to the first agitating member, conveying the developer in the same direction as the conveying direction by the first agitating member while agitating, and delivering the developer to the developer supplying and recovering portion through the communication portion; and a projection-shaped guide arranged in an inner bottom surface of the housing positioned between the first agitating member and the second agitating member so as to extend from one side of the direction of the rotating axis of the first agitating member and the second agitating member to the other side, wherein a cross sectional shape of the guide which is orthogonal to the axial direction of the rotating axis being a mountain shape with a wide foot portion, wherein the guide is arranged in such a manner that gaps between respective outermost portions of the first agitating member and the second agitating member, and the inner bottom surface of the housing and the guide become 1.5 mm or more and 3 mm or less, wherein the first agitating member and the second agitating member are rotated in such a manner that the developer is conveyed from the below to the above in portions which are opposed to each other, and wherein a braking portion inhibiting the developer from being discharged is provided on a downstream side of the developer agitating portion of the housing in the developer conveying direction of the first agitating member, a discharge portion is provided on a downstream side of the braking portion, and the discharge portion is provided with a developer discharge port discharging the developer coming to the discharge portion over the braking portion.

2. The developing apparatus according to claim 1, wherein a backward wound portion is provided in a range including the communication portion on the downstream side in the developer conveying direction of the second agitating member and an upstream side of the communication portion.

3. The developing apparatus according to claim 1, wherein a rib protruding in a diametrical direction from the rotating shaft of the first agitating member is provided.

4. The developing apparatus according to claim 1, wherein a rib protruding in a diametrical direction from the rotating shaft of the second agitating member is provided.

5. The developing apparatus according to claim 1, wherein a rib protruding in a diametrical direction from the rotating shaft of the first agitating member is provided, a rib protruding in a diametrical direction from the rotating shaft of the second agitating member is provided, and the ribs are arranged in such a manner that the ribs of the first agitating member and the second agitating member are not symmetrical with each other with respect to a surface which is orthogonal to a surface connecting axes of the respective rotating shafts of the first agitating member and the second agitating member, in the case that the first agitating member and the second agitating member are rotated at the same rotating speed.

6. The developing apparatus according to claim 1, wherein a toner supplying opening portion is provided above the second agitating member.

7. The developing apparatus according to claim 1, wherein a disc of which surface is directed in a direction which is orthogonal to the developer conveying direction is provided in the braking portion of the first agitating member, and a backward wound portion is provided on an upstream side in the developer conveying direction of the disc.

8. An image forming apparatus comprising a developing apparatus according to claim 1.

* * * * *